United States Patent [19]

Birenbaum et al.

[11] Patent Number: 4,768,151

[45] Date of Patent: Aug. 30, 1988

[54] ELECTRONIC BINGO CARD MANAGER

[75] Inventors: Kenneth A. Birenbaum; Stephen E. Hutchison; Mark K. Virkus; Chester F. Jankowski, all of St. Louis, Mo.

[73] Assignee: Bingo Brain, St. Louis, Mo.

[21] Appl. No.: 944,859

[22] Filed: Dec. 22, 1986

[51] Int. Cl.[4] ..... G06F 15/44; A63F 3/06

[52] U.S. Cl. ..... 364/410; 273/269

[58] Field of Search ..... 273/269; 364/410

[56] References Cited

U.S. PATENT DOCUMENTS

| | | | |
|---|---|---|---|
| 4,373,726 | 2/1983 | Churchill | 273/139 X |
| 4,378,940 | 4/1983 | Gluz | 273/269 X |
| 4,475,157 | 10/1984 | Bolan | 273/269 X |
| 4,651,995 | 3/1987 | Henkel | 273/269 X |
| 4,661,906 | 4/1987 | DiFrancesco | 273/269 X |

FOREIGN PATENT DOCUMENTS 8604826 8/1986 World Int. Prop. O. ..... 273/269

OTHER PUBLICATIONS

Bingo Verifier Advertisement.

*Primary Examiner*—Jerry Smith
*Assistant Examiner*—Steven G. Kibby
*Attorney, Agent, or Firm*—Neal Kalishman

[57] ABSTRACT

An electronic device for managing at least two bingo cards. The device has stored standard card configurations which correspond to physical cards which have been selected by a player. Also stored are standard winning patterns. The processor compares "called" numbers with card configurations which correspond to the physical cards being played by the user. The device alerts the player when a winning card occurs. When "padded" paper cards are used, the device generates each succeeding game board.

19 Claims, 3 Drawing Sheets

ELECTRONIC BINGO CARD MANAGER

BACKGROUND OF THE INVENTION

I. Field of the Invention

The invention is directed to an electronic portable device which is capable of monitoring standard bingo cards. In particular, the invention is directed to an electronic device for assisting individuals in the playing of bingo where a number of cards and a number of games are played during a session.

II. Description of the Prior Art

Bingo has developed in recent years from a game played primarily by friends for enjoyment or token prizes to a commercial form of entertainment. Commercial bingo is played in special private bingo parlors and at religious and charitable organiza- tions.

This commercialization of bingo has enticed large number of people to play on a regular basis. In order to increase their chances of winning many people play more than one card during a game. However, these players usually play no more than twelve cards at one time since it is difficult to manage substantially more cards during a game. A bingo card is a square that is divided into a 5×5 matrix. The numbers in the first column range from 1 to 15 and the numbers in the second column from 16 to 30. The third column contains numbers from 31 to 45 and the fourth column has numbers from 46 to 60. The final column has numbers 61 to 75. The space in the center of the board is blank and contains no number.

There are two predominant types of bingo cards. The traditional card is referred to as a "hard card". These cards are usually manufactured from cardboard or plastic and are designed to be collected after each session for subsequent reuse. A session usually involves the playing of a number of games. Each card usually has an identification number which corresponds to the number configuration shown on the card. These number configurations and identification numbers are standard among most bingo card manufacturers. That is, a manufacturer uses the same identification number to always represent a particular number configuration and many of the manufacturers have jointly adopted a common identification number system.

The second type of cards are referred to as "padded paper cards". These cards are manufactured from paper and are designed to be thrown away after each game. A player at the beginning of the session purchases one or more pads of cards. Each pad is composed of a number of different colored sheets. The top sheet is to be used for the first game. After the first game, the top sheet is discarded and the next sheet is used for the second game. This process continues until all of the sheets have been used and the session ends.

The paper sheets usually have more than one bingo board or bingo card per sheet. Each board on the top sheet has a corresponding board on each subsequent sheet. Although the corresponding boards are not related, their respective identification numbers of the boards on the sheets are numerically related. That is, each board has an equal displacement from the previous board on the sheet. For example, if the top sheet contains boards with identification numbers 100, 151, 325 and 670 then the next sheet will contain boards with identification numbers 200, 251, 425 and 770. The third sheet could contain boards 235, 286, 460 and 805. Like the hard cards, the manufacturers of the paper cards usually use the same identification number for the same configuration. Also, like the hard cards, many manufacturers have adopted a common set of identification numbers and number configuration combinations.

In light of bingo's popularity, there have been several proposals for devices which are capable of managing a number of bingo cards. One such device is disclosed in U.S. Pat. No. 4,378,940. This device can only be used at a limited number of bingo parlors. To use the device special bingo cards must be used so that the number patterns can be read by the unit. This makes the device of limited use since few parlors have the special cards which are required.

A second device is disclosed in U.S. Pat. No. 4,475,157. This device utilizes a manual input system which requires that each number from each card be manually entered into the memor of the unit. This manual entry procedure is undesirable since it takes a long time to enter a number of cards. It would be almost impossible to reprogram the machine between games when a player has several paper pads of cards that need monitoring.

The present invention is advantageous for a number of reasons. First, it allows a bingo player to manage a large number of cards. Second, it facilitates the entry of the number configuration on a card into the unit memory. Third, it allows the player to select or design any possible wirering combination of board positions. Fourth, the unit can be adopted for use with any card manufacturer's identification number designation system. And finally, it can be economically produced and can be operated after the user learns only a couple of simple commands.

SUMMARY OF THE INVENTION

A device and method for managing at least two bingo cards which comprise a memory, calculating unit, entry means and communication means. The memory has stored number configurations corresponding to the number configurations on bingo cards. The calculating unit receives selected number configurations from the memory and selected numbers from the entry means. The calculating unit is also instructed by the entry means as to what constitutes a winning pattern of numbers. The calculating unit compares the numbers which are sequentially entered with the numbers contained in the number configurations. The data from the calculator unit is displayed to the user through the communication means.

BRIEF DESCRIPRION OF THE DRAWINGS

DESCRIPTION OF THE PREFERRED EMBODIMENTS

Figure 1:
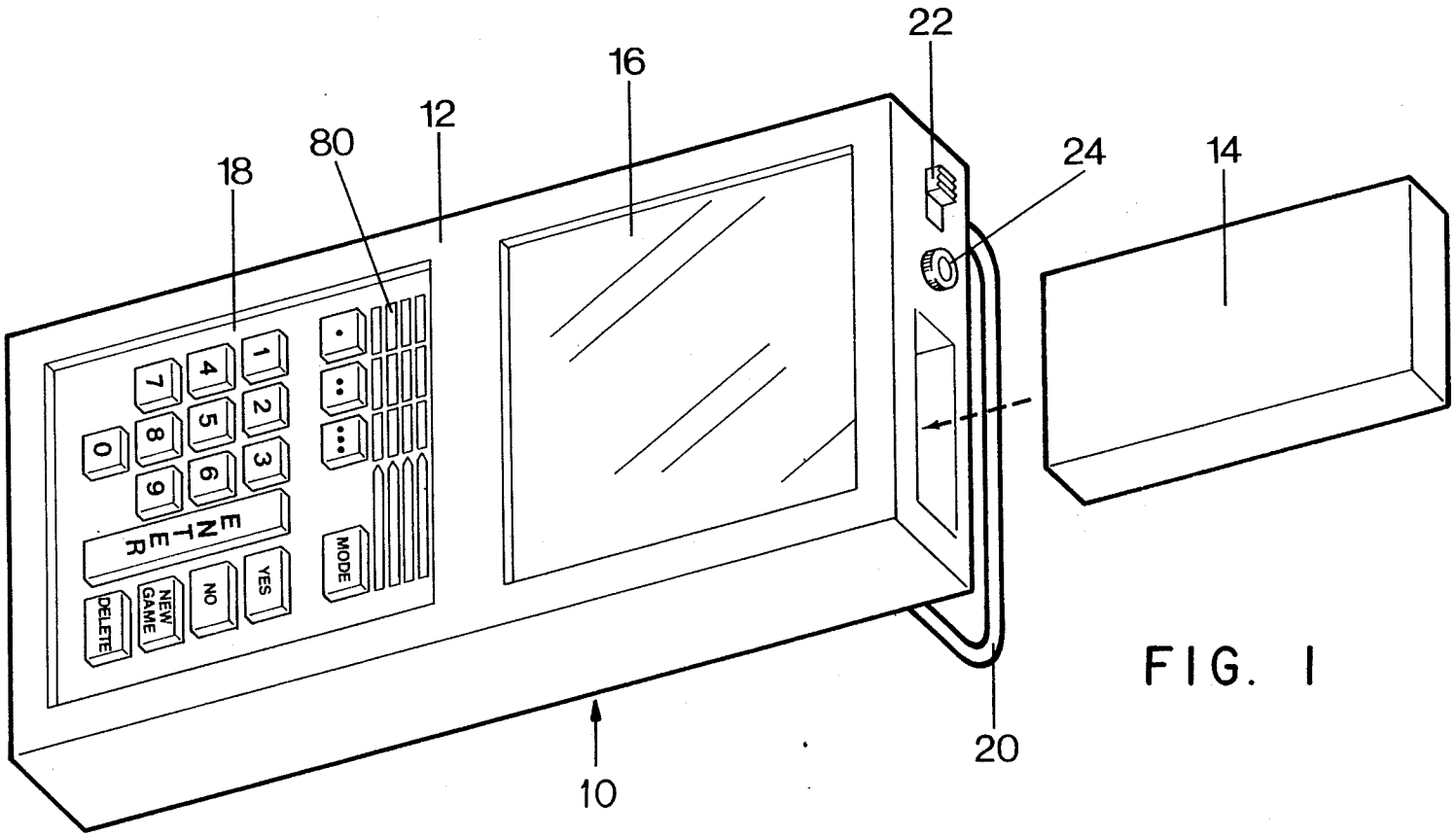
FIG. 1 is a pictorial drawing illustrating the device of the invention.
Figure 2:
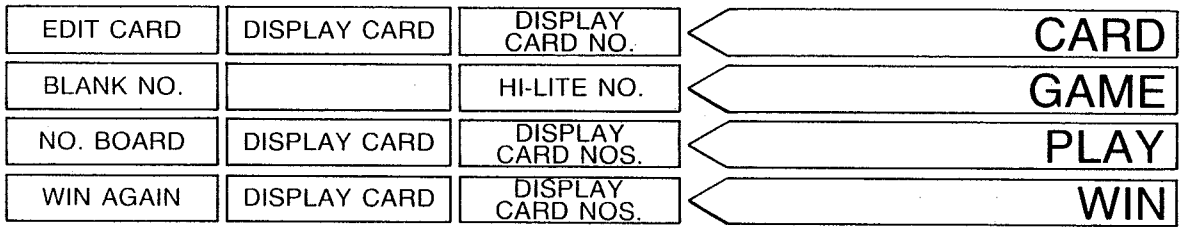
FIG. 2 is an illustration of the printed material 80.
Figure 3:
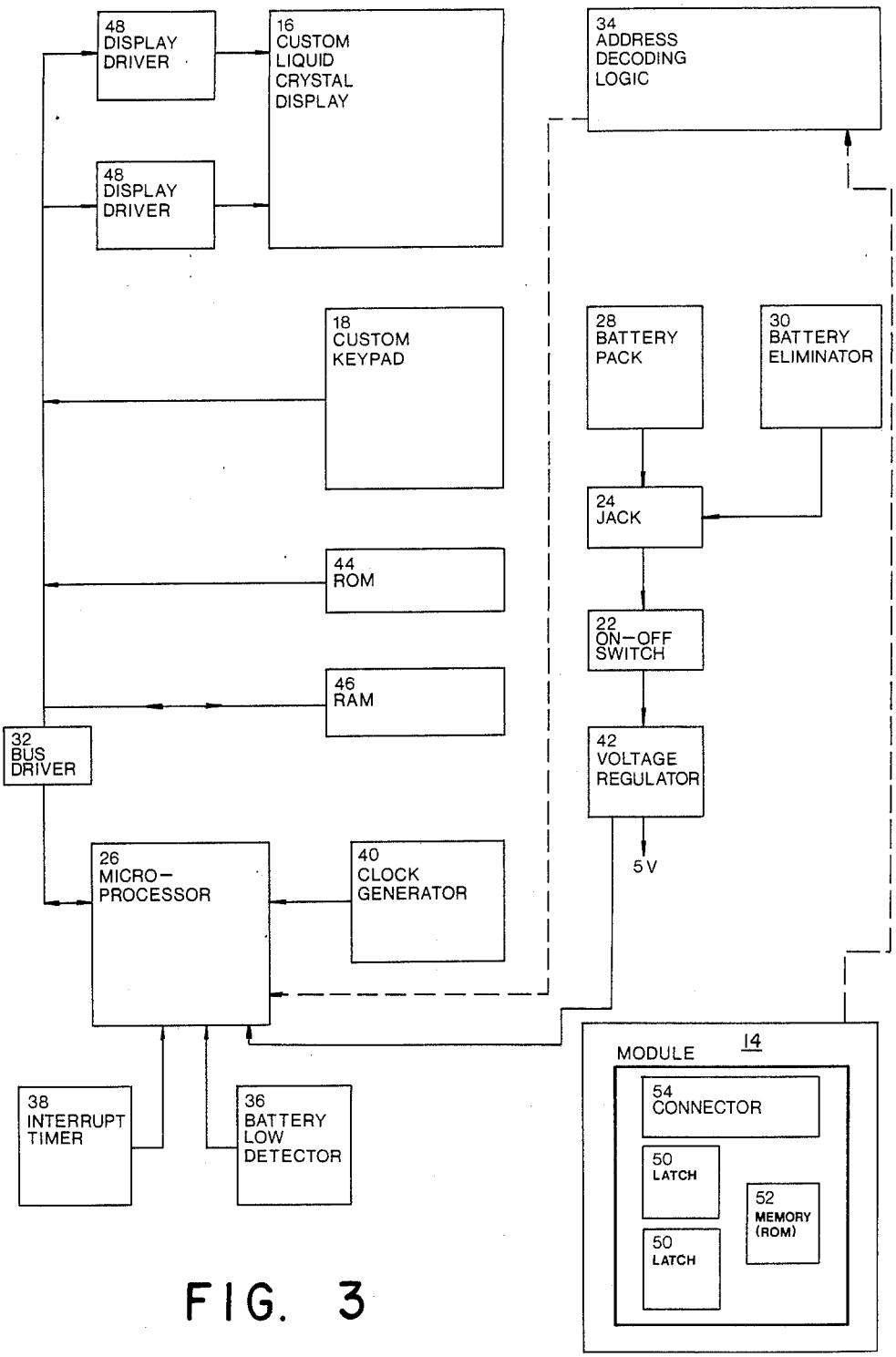
FIG. 3 is a block diagram illustrating the device of the invention.

As shown in FIG. 1 the device 10 of the invention comprises a main body 12 and a plug in memory module 14. The main body 12 comprises a liquid crystal display 16, an entry key pad 18, a stand 20, an on-off switch 22 and a jack 24 for an alternative power source. FIG. 2 illustrates the printed matter 80 which facilitates the operation of the device 10. The stand 20 can be adjusted to multiple positions and also functi.ons as a handle. As indicated by the block diagram in FIG. 3 the device 10 contains a processor 26 which is contained on a printed circuit board.

The main body 12 is made from plastic and can be opened to insert batteries 28 usually six AA batteries. A conventional battery eliminator 30 can be used to avoid the necessity of batteries 28. The external power source is connected through jack 24. The on-off switch 22 controls the flow of power from either the batteries 28 or the battery eliminator 30 to the unit.

A preferred processor circuit board contains:

(1) on-off switch 22

(2) processor and bus drivers 32

(3) address decoder circuitry 34

(4) battery low detector 36

(5) interrupt timer for alerting the processor to possible system malfunction 38

(6) clock generator for synchronizing the processor (7) voltage regulator 42

(8). ROM 44 and RAM 46

A preferred second circuit board contains:

(1) keyboard 16

(2) display drivers 48

(3) liquid crystal display 16

A preferred plug in memory module 14 contains:

(1) latching circuitry 50

(2) ROM 52

(3) 24 pin card edge connector

Each of the above elements are standard in the industry. For instance the processor ROM 44 is a Toshiba TC5364P and the RAM 46 is a Toshiba TC5564PL. The address decoder circuitry 34 is preferably a Motorola 74HC138 and the processor 32 is a Hitachi HD63B09EP. The latching circuitry 50 is preferably a Motorola 74HC374 and the module ROM 52 is a Toshiba 7C531000P with 128K. The liquid crystal displays and key pad technology is also commercially available from a number of manufacturers. Other types of entry and calculation means could be employed in the device of the invention, such as, CRT displays.

The processor circuit board ROM 44 (read only memory) contains the bingo algorithm for playing the bingo game. It also contains the winning game patterns. The RAM 46 (random access memory) contains the copied card configurations and serves as a work area for the processor. The memory module ROM 52 contains the bingo card configurations which usually number approximately 9,000.

The following explains the method of the invention (1) The user must determine whether hard or padded, paper cards are being used;

(2) the user must determine which standardized set of number configurations are being used and insert the appropriate memory module into the unit;

(3) the user turns on the unit;

(4) the user via the key pad instructs the processor to expect the identification number of the number configurations contained on the cards (number of cards is only limited by size of processor memory) for the first game.

(5) the user via the key pad sequentially inputs the identification number of each bingo card;

(6) the identification number is located in the memory module and the processor copies each card from the memory module;

(7) the number configurations which are in base sixteen are stored in the memory module in twelve byte strings with the numbers from the first column less 7, the second column less 16, the third column less 31, the fourth column less 46, and the fifth column less 61, when copied into the processor the numbers are translated into the actual card numbers by adding the appropriate amount and are arranged into a bingo card format;

(8) if a module is not available for the particular cards used, the number configuration can be manually entered into the unit;

(9) the unit has possible winning patterns stored in its memory, the user through the key pad instructs the processor which pattern is the winning pattern for the game;

(10) if one of the stored patterns is not the desired pattern, then a pattern can be manually entered through the key pad;

(11) the unit is ready for play and through the key pad the processor is instructed to expect numbers which have been chosen by caller;

(12) as each number is "called" it is entered into the processor through the key pad;

(13) each number that is entered into the processor is translated into base sixteen;

(14) the processor automatically compares the entered number with the numbers contained in each of the stored number configur- ations;

(15) when a match is found the position in the number configuration is identified;

(16) following the identification of the matched numbers and prior to the entry of the next number, the processor checks to determine whether the matched numbers in each number configuration conform to the winning pattern;

(17) if a number configuration has a number sequence which conforms to the winning number, the winning number configuration is displayed showing the winning pattern; and

(18) a new game can be started through a key pad command.

The device has a number of features which makes it particularly suitable for managing bingo cards. Each entry is shown on the display as it is tapped into the key pad. Thereby, errors can be immediately detected. Also, the processor can provide the user with a list of previously entered numbers and can delete a number which was mistakenly entered. Further, the processor can display each of the number configuration in the order of their being the closest to being the winning pattern. (for efficiency it is preferred that the device display only the closest five configurations) Thus, the device provides the user with status information on not only each card but as to the overall status of all cards being played by the user.

A further feature of the invention is that when padded paper cards are used the processor automatically enters the next set of cards after the previous game has ended. Since the identification numbers between the boards on sheet of game cards is related, the processor once given the displacement between cards calculates the identification of the new cards and copies them from the memory module. This is critical since there is usually very little time to make such entries between games.

The device can also be used when the cards do not contain standard identification numbers. The first column of numbers can be entered into the processor which then generates possible number configurations by matching the first column with the number configurations in its memory. The possible number configurations are then displayed to the user for selection of the one which matches his card.

We claim:

1. A hand held device for managing at least two bingo cards which comprises:

(a) memory means having stored number configurations that are associated with identification numbers some of which correspond to the number configurations and related identification numbers contained on at least some bingo cards;

(b) calculation means which comprise means for retrieving selected number configurations from said memory means, means for sequentially recording and comparing selected numbers with those number configurations which have been retrieved from the memory means; and means for determining whether the location of said selected numbers in said number configurations forms a selected pattern;

(c) entry means for communicating with said calculation and memory means; and (d) communication means for providing data from said calculation means to an operator, wherein said entry means instructs the memory means and calculation means through the use of said identification numbers which number configurations are to be retrieved from the memory means into the calculation means.

2. The device of claim 1 wherein said memory means is a separable unit.

3. The device of claim 2 wherein said memory means contains the number configurations of specific bingo card manufacturers.

4. The device of claim 1 wherein said calculation means comprises a microprocessor, a ROM, a RAM and clock generator.

5. The device of claim 1 wherein said entry means comprises a key pad.

6. The device of claim 5 wherein said key pad comprises numerical keys and function keys.

7. The device of claim 1 wherein said entry means provides the calculation means with winning patterns.

8. The device of claim 1 wherein said entry means provides the calculation means said selected numbers.

9. The device of claim 1 wherein said entry means instructs said calculation means which configuration is to be retrieved from the memory means.

10. The device of claim 1 wherein said entry means instructs said calculation means when a new game has commenced.

11. The device of claim 1 wherein said communication means comprises a liquid crystal display.

12. The device of claim 1 wherein said entry means instructs the calculation means as to what data to transmit to said communication means.

13. A method for managing at least two bingo cards which comprises:

(a) permanently storing number configurations some of which correspond to the number configurations contained on at least some bingo cards;

(b) selecting certain number configurations by use of an identification number that appears on the cards that are to be played;

(c) transferring said selected number configurations from storage to a calculating unit;

(d) selecting a pattern of number positions which determines a winning configuration;

(e) imputing selected numbers and determining whether each of said number matches one of the numbers in said number configurations;

(f) following said matching, determining whether the matched umbers in any of the number configurations corresponds to the elected winning number positions; and (g) displaying the information contained in said calculating unit.

14. The method of claim 13 wherein said method further comprises storing said number configurations in a separable unit.

15. The method of claim 13 wherein said selected numbers are inputted through a key pad.

16. The method of claim 13 wherein said number configurations are related to specific bingo card manufacturers.

17. The method of claim 13 wherein the number configuration closest to winning is displayed.

18. The method of claim 13 wherein the number configurations for the next game having identification numbers which are displaced in a predetermined relationship from the identification numbers of the previous game are automatically transferred from storage to the calculating unit without entering the identification numbers of the selected number configurations.

19. The method of claim 13 wherein the number configuration and identification number are determined by use of the first column of bingo card numbers.

* * * * *